United States Patent [19]

Coleman et al.

[11] Patent Number: 4,716,989

[45] Date of Patent: Jan. 5, 1988

[54] ELEVATOR COMPENSATING CABLE

[75] Inventors: John D. Coleman; Donald L. Obst, both of Hickory, N.C.

[73] Assignee: Siecor Corporation, Hickory, N.C.

[21] Appl. No.: 405,147

[22] Filed: Aug. 4, 1982

[51] Int. Cl.[4] ..... B66B 9/00

[52] U.S. Cl. ..... 187/1 R; 187/94; 59/78

[58] Field of Search ..... 187/1 R, 94, 20; 59/78, 59/82, 93; 428/328

[56] References Cited

U.S. PATENT DOCUMENTS

| | | | |
|---|---|---|---|
| 847,228 | 3/1907 | Bixby, Jr. | 59/78 |
| 1,360,456 | 11/1920 | Shiner | 59/78 |
| 3,574,996 | 4/1971 | Loos | 59/78 |
| 3,768,596 | 10/1973 | Solymos | 187/94 |
| 3,991,856 | 11/1976 | Shigeta et al. | 187/1 R |
| 4,243,710 | 1/1981 | Magrini et al. | 428/328 |
| 4,247,594 | 1/1981 | Shea et al. | 428/328 |
| 4,305,985 | 12/1971 | Heublein | 428/328 |

FOREIGN PATENT DOCUMENTS 366479 5/1922 Fed. Rep. of Germany .

OTHER PUBLICATIONS

Elevator World; vol. 30, No. 2; published Feb. 1982.
Boston Insulated Wire "Elevator World" vol. 30, #2, Feb. 1982.

*Primary Examiner*—Joseph J. Rolla
*Assistant Examiner*—Kenneth Noland
*Attorney, Agent, or Firm*—Roy B. Moffitt

[57] ABSTRACT

Disclosed is a compensating cable adapted to be used in combination with an elevator cab, counterweight, hoist rope and traveling cable. The compensating cable is composed of a sheath, at least one elongated strength member such as a link chain or stranded wire rope, made from metal or other materials of high tensile strength disposed in the sheath and the volume of the sheath not otherwise occupied by the strength member substantially occupied by a mixture of metal particles and plastic.

23 Claims, 8 Drawing Figures

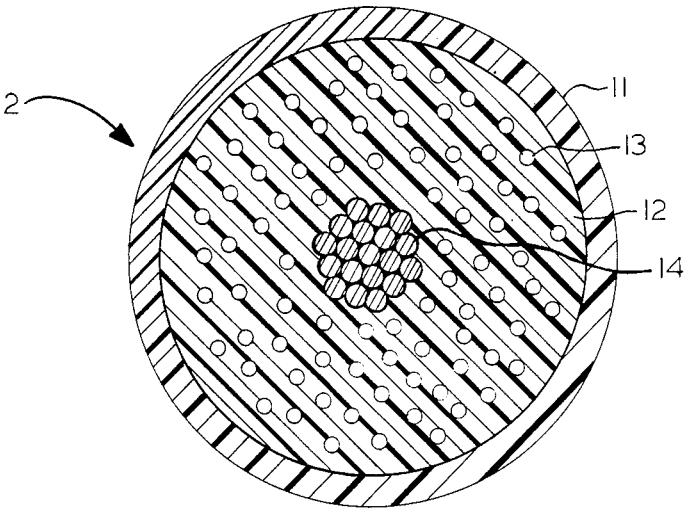
FIG. 4
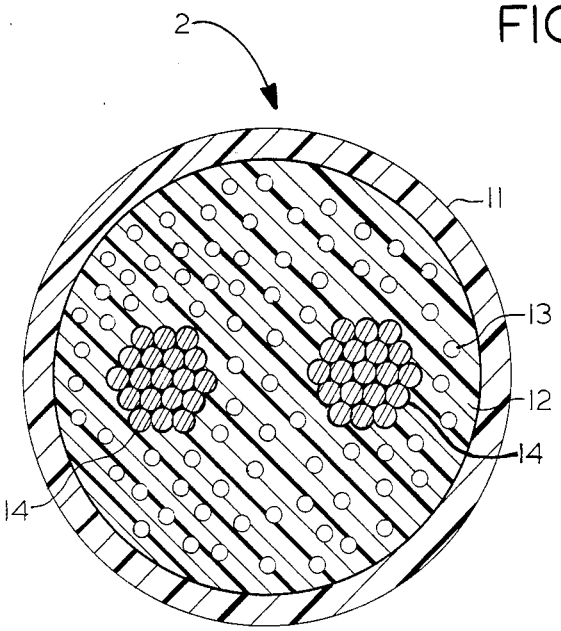
FIG. 5
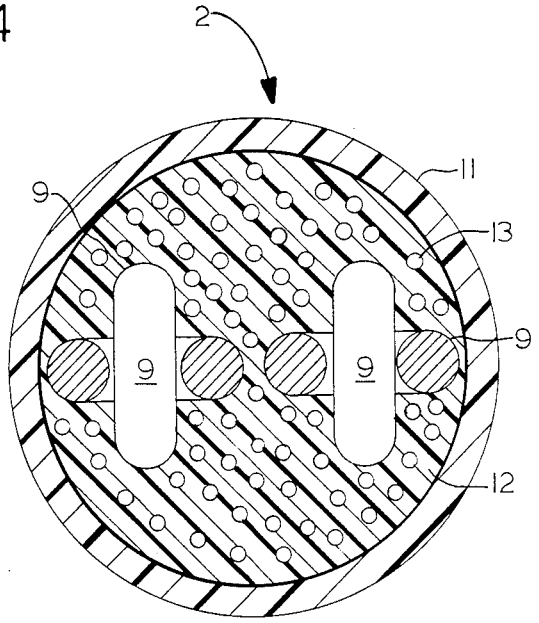
FIG. 6
FIG. 7
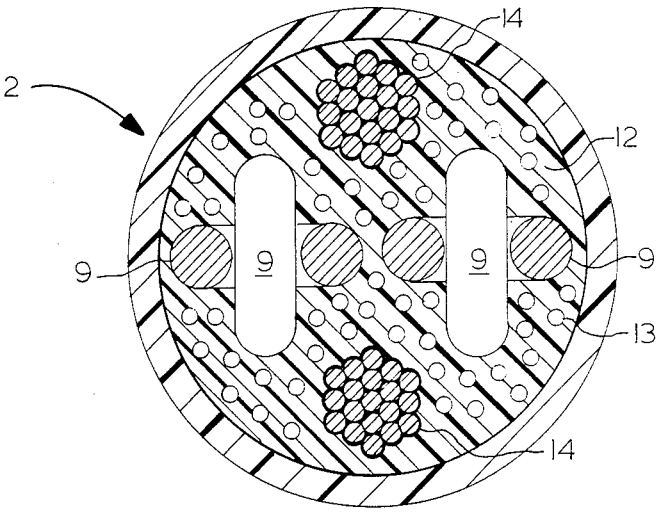

ELEVATOR COMPENSATING CABLE

BRIEF SUMMARY OF THE INVENTION

The basic elements of a simple elevator system are: a sheave, a counterweight, an elevator car, a compensating cable or counterweight rope, a hoist rope and a traveling cable. All of these are assembled in an elevator well or shaft in a well known manner. As a general rule, the elevator car is connected to a counterweight by a hoist rope threaded over one or more sheaves or pulleys located in the upper reaches of the shaft. One end of the compensating cable is connected to the counterweight and the other to the bottom of the car in some cases after having been threaded over a compensating sheave located in the bottom of the elevator well. In most instances, however, the compensating cable is left to hang threaded over a compensating sheave located in the bottom of the elevator well. In most instances, however, the compensating cable is left to hang free without being threaded over a sheave. One end of the traveling cable is connected to the car bottom and the other into a junction box affixed to the elevator well sidewall. Signals are sent via the traveling cable to a means causing the car to obey commands sent thereover. The counterweight is essentially the same weight as the car and the weight of the hoist ropes essentially equal the weight of the compensating chain as more fully disclosed hereafter.

A prime function of the compensating cable is to provide dynamic weight counterbalance to the weight of the hoist rope(s) as the car goes up and down in the elevator shaft so that the car is dynamically balanced. For optimum performance, the aggregate weight of the hoist rope and traveling cable should be essentially equal to the weight of the compensating cable at any given position of the car in the elevator shaft. In addition, the length of the hoist rope between the car and sheave should be equal to the length of the compensating chain between the counterweight and the lowest portion of the compensating chain or, stated alternatively, the length of the hoist rope from car to counterweight is essentially equal to the length of the compensating cable from car to counterweight Prior art compensating cables usually were nothing more than a link chain. Constant raising and lowering of the elevator car caused such chain also to be raised and lowered, rubbing one link against the other causing noise and abrasion. Link chains when hung free in an elevator shaft (no bottom sheave) have tendency to form a "point" and not a loop, i.e., the side legs of the chain tend to converge on a single link and form a point at the terminus of the "loop" formed by the chain. Such a configuration results in a propensity of one leg of the chain to rub against another during car movement: noise and abrasion result. More often than not, chain type compensating cable would bang into the sidewalls of the elevator shaft and cause damage and additional noise. Noise was so much of a problem that some prior art compensating chain type cables either used a sash cord (a rope woven in the links of the chain) or employed a plastic coating over the link chain. One such commercially available compensating chain sold under the trademark QUIETLINK and advertised to reduce noise and the need for a sash cord, is a link chain disposed in a plastic sheath, the plastic sheath being drawn down as close as possible to the individual link members. See, for example, U.S. Pat. No. 3,574,996.

The present invention does not just reduce noise and abrasion, it virtually eliminates them as well as the need for a sash cord. Compared to known prior art chain type compensating cable, the disclosed compensating cable has a higher weight per linear length, is smaller for a given weight per linear length, and has less lateral cable sway, i.e., it is less likely to bang into the sidewalls of the elevator shaft. All of these features arise out of its unique structure, i.e., a sheath, a link chain or wire rope disposed in the sheath, and the volume of the sheath not otherwise occupied by the link chain or wire rope substantially occupied by mixture of metal and plastic. Furthermore, compared to prior art link chain type compensating cables, the disclosed compensating cable is a stiffer, inherently forms a free hanging loop between the car and counterweight whose legs are spaced apart, noiseless and has an ease of travel unknown to the prior art.

BRIEF DESCRIPTION OF THE DRAWINGS

FIG. 4 is a cross section of another embodiment of the compensating member in FIG. 1 along line 2—2.

FIG. 5 is a cross section of still another embodiment of the compensating member of FIG. 1 along line 2—2.

FIG. 6 is a cross section of an additional embodiment of the compensating member of FIG. 1 along line 2—2.

FIG. 7 is a cross section of another embodiment of the compensating member of FIG. 1 along line 2—2.

DETAILED DESCRIPTION OF THE INVENTION

Figure 1:
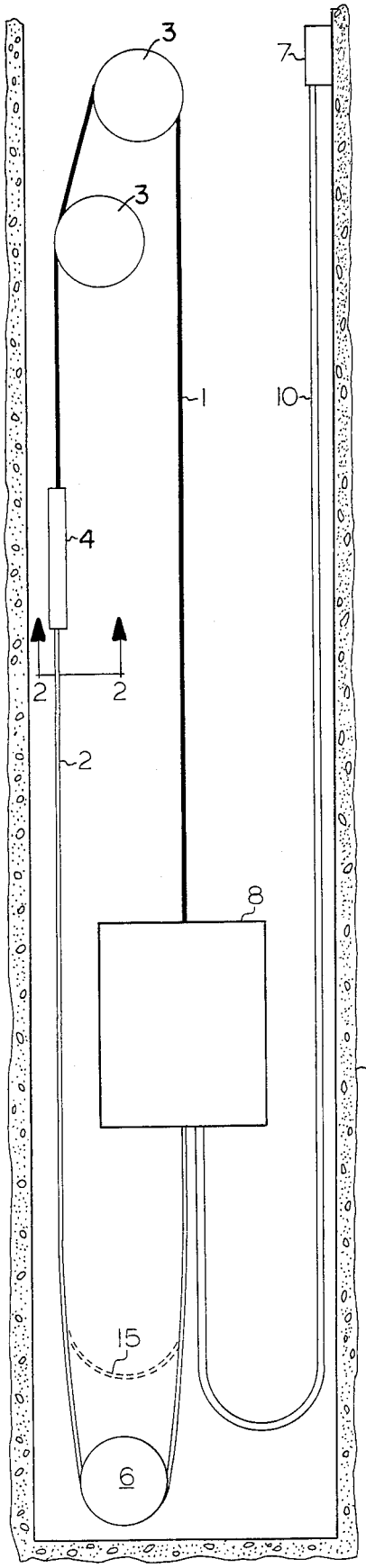
FIG. 1 is a schematic representation of an elevator system employing a compensating member.

The instant invention concerns itself with a compensating cable sometimes called a counterweight rope. As shown in FIG. 1, the compensating cable 2 is connected to the bottom of car 8 and to the bottom of counterweight 4. Sometimes, but not always, the compensating cable many be traversed over compensating sheave 6 or it may hang free in a loop like control cable. See element 15. As a general rule, the length of compensating chain 2 (from car 8 to counterweight 4) should be essentially the same length as hoist rope 1, i.e, from car 8 over sheaves 3 to counterweight 4 [excluding wrap around portion around the sheave(s) if any]. Hoist rope 1 is connected to the roof of car 8, traversed over sheaves 3 and connected to the top of counterweight 4. Because of safety factor reasons, there may be five or more hoist ropes and the aggregate weight of such hoist ropes should approximately equal the weight of compensating chain 2. This does not mean that if there are five compensating chains required, there must be five hoist ropes. There may be only one compensating chain and a plurality of hoist ropes, so long as the length of compensating chain 2 (from car 8 to counterweight 4) is essentially the same as the distance, but not the aggregate distance, covered by all hoist ropes between car 8 and counterweight 4 and its weight is essentially equal to the aggregate weight of hoist ropes 1 and control cable 10. The weight of control cable 10 is usually negligible comparative to that of the hoist ropes, it is terminated at junction box 7, and car 8, and is used to govern the car movement in a manner well known to the art.

Figure 2:
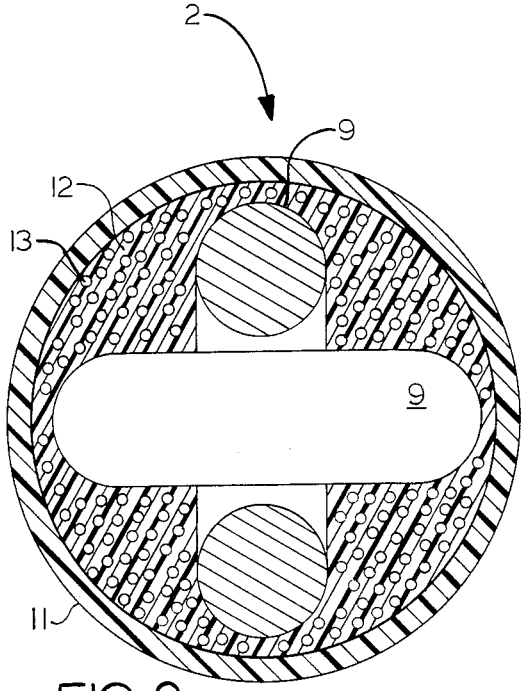
FIG. 2 is a cross section of one embodiment, the compensating membr of FIG. 1 along line 2—2.
Figure 3:
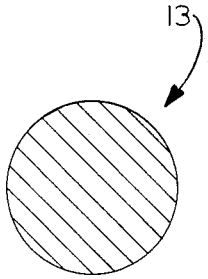
FIG. 3 is a cross section of some of the metal particles of FIGS. 2 and 4.

Turning to FIG. 2, shown by element 2 is a cross section of one embodiment of compensating cable 2. Plastic sheath 11 made from either a polyamide, a polyolefin, polyvinyl chloride, rubber, polyurethane or mixtures thereof, is primarily a tube in which there is disposed link chain 9, composed of a plurality of links interconnected one to another. See U.S. Pat. No. 3,574,996 for an example. The volume delimited by the intermost surface of sheath 11 not otherwise occupied by link chain 9 (referred to hereafter as "the volume") is essentially occupied by metal particles 13 suspended in a plastic 12. The metal particles can be ferrous and nonferrous of any desirable particle size and shape, preferably between 0.020 and 0.040 inches in diameter in an amount so that 50 to 75 percent of the volume is occupied by them. The balance of the volume is occupied by plastic 12, which may be of the same materials as listed above for sheath 11.

It will be noted that the outer surface of sheath 10 is not necessarily undulating, as taught by the prior art, and may present an essentially circular cross section as shown in FIG. 2, although it may be undulating if desired. Metal particles 13 result in a compensating cable having a greater weight per linear length than prior art chains. When prior art compensating chains are compared to compensating cable of the instant invention, it has been found that for a given equal length, a prior art compensating chain having links made of ⅜ inches diameter steel was equivalent to a compensating cable of the instant invention having a chain made of steel links of only ¼ inches in diameter. Link chains made from high tensile strength non-metallic materials such as nylons and aramids are also suitable. The links of the chain of the invention have a propensity to stay fully extended because of filler material 12 and 13, contrary to prior art compensating chains that permitted the link chain to shrink in length as a result of one link sliding within the link to which it is connected. A fully extended link chain results in an evenly distributed weight, eliminates noise, abrasion of one link on another, preserves the cylindrical surface of sheath 10 and avoids the problem of sheath cracking, which is experienced when using chains of the type disclosed in U.S. Pat. No. 3,574,996.

The method of making the compensating chain 2 involves apparatus and method steps known to the prior art. For example, U.S. Pat. No. 3,574,996 teaches the method and apparatus of extruding a sheath over a preform (a link chain). A preform composed of link chain 9 and metal plastic volume 12 and 13 is first formed by means of extrusion. Thereafter plastic sheath 10 is extruded over the previously described preform.

Metals such as lead, iron, steel, copper and mixtures thereof have been found suitable for use in this invention having a preferred particle size so that all such particles willl pass an opening of 0.0394 inches, 10% maximum will not pass a screen opening of 0.0331 inches, 85% minimum will not pass a screen opening of 0.0232 inches and 97% minimum will not pass a screen opening of 0.0197 inches. Some or all of such metal particles may be spherical and/or shapes other than spherical.

In FIG. 4 there is shown another embodiment of the invention using a stranded metal wire rope 14 instead of a link chain 9. Most any commercially available wire rope has been found to be suitable, especially those made from twisted or stranded filaments of steel. Wire rope made from high tensile strength nylons and aramids are also suitable. FIGS. 5 and 6 disclose two additional embodiments of the invention employing a plurality of wire ropes (FIG. 5) or link chains (FIG. 6). Obviously there may be more than two link chains or wire ropes (see FIG. 7) within a given sheath 10 and wire ropes may be substituted for link chains and treated as equivalents for purposes of this disclosure.

Figure 8:
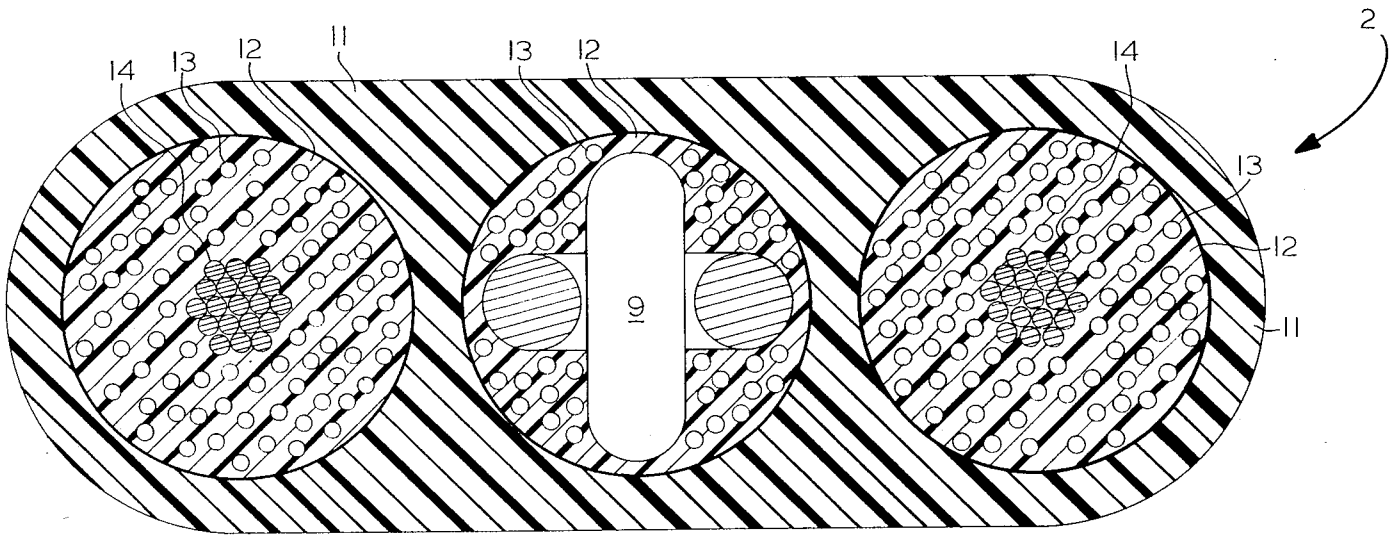
FIG. 8 is a cross section of an additional embodiment of the compensating member of FIG. 1 along line 2—2.

Shown in FIG. 8 is a flat type embodiment of the compensating cable 2. It is composed of a plurality of spaced apart strength members 9 and/or 14, each with their respective axis arranged in a line and in substantially coplanar relationship with one another. Jacket 11 is made from a flexible material, examples of which have been previously discussed and contains a plurality of elongated cavities, the axis of which are also arranged in a line and in substantially coplanar relationship with one another. Each of the cavities contains at least one strength member (9 and/or 14); they may alternatively contain two or more strength members like that shown in FIGS. 5, 6 and 7. The volume in the cavities not otherwise occupied by the strength members 9 and/or 14 is substantially filled with metal particles 13 and plastic 12 as previously described. Element numbers common to FIGS. 2, 3, 4, 5, 6, 7 and 8 represent like elements first described.

As mentioned earlier, most elevator systems do not employ a bottom sheave 6, especially when the system is installed in a well or shaft 6. Systems installed in non-shaft or well situations where the compensating cable if left to hang free would be subject to wind or other forces usually employ sheave 6 or its equivalent. Chain type compensating members of the prior art if installed in a shaft or well 16 have a tendency to come together at a link point in the general location where loop 15 is shown. This arises out of the relatively limber nature of the chain and the restricted lateral space in the elevator shaft 16. The closer together the legs of compensating member 2 are to one another, the more likely a prior art compensating chain type member would exhibit this "point" tendency. It is at this point, which is a dynamic one as car 8 moves up and down, where one link strikes another, giving rise to undesirable noise and abrasion and a tendency of one leg of the chain to slam into the car.

Although the invention has been described in considerable detail, such detailed description is only for the purpose of illustrating specific embodiments. It is evident that variations and modifications can be made from those described without departing from the spirit and scope of the invention.

We claim:

1. An elongated member comprising:
(a) an elongated sheath;
(b) at least one elongated strength member disposed in said sheath; and,
(c) the volume of said sheath not otherwise occupied by said elongated strength member substantially occupied by a mixture of metal particles and plastic.

2. The elongated member of claim 1 wherein said elongated strength member is either a stranded wire rope or a link chain.

3. The elongated member of claim 1 wherein said sheath is composed of a material selected from the group consisting essentially of rubber, polyamides, polyurethane, polyvinyl chloride, polyolefins, and mixtures thereof.

4. The elongated member of claim 1 wherein there are a plurality of elongated strength members.

5. The elongated member of claim 4 wherein said elongated strength members are either all link chains or stranded wire ropes or a combination of at least one link chain and one stranded wire rope.

6. The elongated member of claim 1 wherein said metal particles are either ferrous or nonferrous metals or mixtures thereof and at least some of which are spherical in shape.

7. The elongated member of claim 1 wherein said metal particles are steel and have a particle size between 0.02 and 0.04 inches.

8. The elongated member of claim 1 wherein the volume of the metal particles occupy 50 to 75 percent of the sheath volume not otherwise occupied by the elongated strength member.

9. The elongated member of claim 1 wherein the volume of the plastic occupying the sheath volume not otherwise occupied by the elongated strength member and metal particles is between 50 and 25 percent.

10. The elongated member of claim 2 wherein the plastic occupying the volume not otherwise occupied by the elongated strength member and the metal particles is selected from the group consisting essentially of rubber, polyolefins, polyvinyl chloride, polyamides, polyurethane, and mixtures thereof.

11. The elongated member of claim 1 wherein the particle size of said metal particles is such that it will pass a screen having screen openings of 0.0394 inches.

12. The elongated member of claim 1 wherein said strength member is made from materials selected from the group comprising steel, iron, polyamides, aramids and graphite.

13. An elevator system comprising a car, a compensating member, a counterweight, and a hoist rope, the hoist rope being connected to the car and the counterweight, the compensating member connected to the counterweight and the car, the improvement wherein said compensating member is composed of:

(a) an elongated sheath (b) at least one elongated strength member disposed in said sheath; and (c) the volume of said elongated sheath not otherwise occupied by said elongated strength member is substantially occupied by a mixture of metal particles and plastic.

14. The elevator system of claim 13 wherein said elongated strength member is either a stranded wire rope or a link chain.

15. The elevator system of claim 13 wherein said sheath is composed of a material selected from the group consisting essentially of rubber, polyamides, polyurethane, polyvinyl chloride, polyolefins, and mixtures thereof.

16. The elevator system of claim 13 wherein there are a plurality of elongated strength members.

17. The elevator system of claim 13 wherein said metal particles are either ferrous or nonferrous metals or mixtures thereof and at least some of which are spherical in shape.

18. The elevator system of claim 13 wherein said metal particles are steel and have a particle size between 0.02 and 0.04 inches.

19. The elevator system of claim 13 wherein the volume of the metal particles occupy 50 to 75 percent of the sheath volume not otherwise occupied by the elongated strength member.

20. The elevator system of claim 13 wherein the volume of the plastic occupying the sheath volume not otherwise occupied by the elongated strength member and metal particles is between 50 and 25 percent.

21. The elevator system of claim 13 wherein the plastic occupying the volume not otherwise occupied by the elongated metallic strength member and the metal particles is selected from the group consisting essentially of rubber, polyolefins, polyvinyl chloride, polyamides, polyurethane and mixtures thereof.

22. The elevator system of claim 13 wherein the particle size of said metal particles is such that it will pass a screen having screen openings of 0.0394 inches.

23. The elevator system of claim 13 wherein said strength member is made from materials selected from the group comprising steel, iron, polyamides, aramids and graphite.

* * * * *